United States Patent [19]

Schneider

[11] Patent Number: 5,069,124

[45] Date of Patent: Dec. 3, 1991

[54] METHOD OF OPERATING A PRINTING MACHINE DURING START-UP OR RUN-ON AND OPTICALLY TESTING A PRINTED IMAGE

[75] Inventor: Josef Schneider, Diedorf-Lettenbach, Fed. Rep. of Germany

[73] Assignee: Man Roland Druckmaschinen AG, Offenbach am Main, Fed. Rep. of Germany

[21] Appl. No.: 496,416

[22] Filed: Mar. 20, 1990

[30] Foreign Application Priority Data

Apr. 1, 1989 [DE] Fed. Rep. of Germany ..... 3910557

[51] Int. Cl.[5] ..... B41F 7/18

[52] U.S. Cl. ..... 101/142; 101/217; 101/451; 101/483

[58] Field of Search ..... 101/483, 484, 217, 141, 101/142, 450.1, 451, 452

[56] References Cited

U.S. PATENT DOCUMENTS

| | | | |
|---|---|---|---|
| 3,203,346 | 8/1965 | Norton et al. | 101/217 |
| 3,460,143 | 8/1969 | Vaccaro | 101/484 X |
| 3,567,923 | 3/1971 | Hutchison | 101/484 |
| 3,654,864 | 4/1972 | Ovshinsky | 101/483 X |
| 3,678,852 | 7/1972 | Feinleib et al. | 101/483 X |
| 3,741,118 | 6/1973 | Carley | 101/483 X |
| 4,004,509 | 1/1977 | Moss | 101/216 |
| 4,759,285 | 7/1988 | Fox et al. | 101/170 |

FOREIGN PATENT DOCUMENTS

| | | |
|---|---|---|
| 2157699 | 6/1972 | Fed. Rep. of Germany . |
| 2718522 | 11/1977 | Fed. Rep. of Germany . |
| 2924912 | 6/1980 | Fed. Rep. of Germany . |
| 3136703 | 11/1982 | Fed. Rep. of Germany . |
| 657314 | 8/1986 | Switzerland . |

*Primary Examiner*—Clifford D. Crowder

*Attorney, Agent, or Firm*—Frishauf, Holtz, Goodman & Woodward

[57] ABSTRACT

During start-up or run-on of a printing machine, a printed image is transferred from a printing cylinder (2, 24, 34) on a control or test cylinder (5, 26, 35) which has a surface representative of the surface of a substrate (6, 25, 33) on which printing, later on, is to be effected, for example a white ceramic surface of roughness comparable to that of paper. The image transferred on the control or test cylinder is optically tested while the cylinder rotates over a first partial circumferential range (7, 27, 36), and data derived, either by human observation or by electro-optical sensors (8, 28, 37) to permit readjustment of operating systems of the printing machine in accordance with desired operating parameters, such as register, inking density, ink/damping fluid relationship in offset processes or the like. The printed image is then erased, extinguished or removed, for example by cleaning, by a cleaning apparatus (13, 30, 39) located in a second subsequent range (12, 29, 38) of the circumference of the control or test cylinder. Ink stripped off the control or test cylinder is recycled, and washing fluid and ink are separated, for separate recycling. When appropriate printing is obtained on the control or test cylinder (5, 26, 35), substrates can then be passed through the printing machine and printing carried out without prior scrap test prints. The method and system are suitable for all printing methods, but are preferably and primarily used in offset printing systems and methods.

20 Claims, 1 Drawing Sheet

FIG. 1
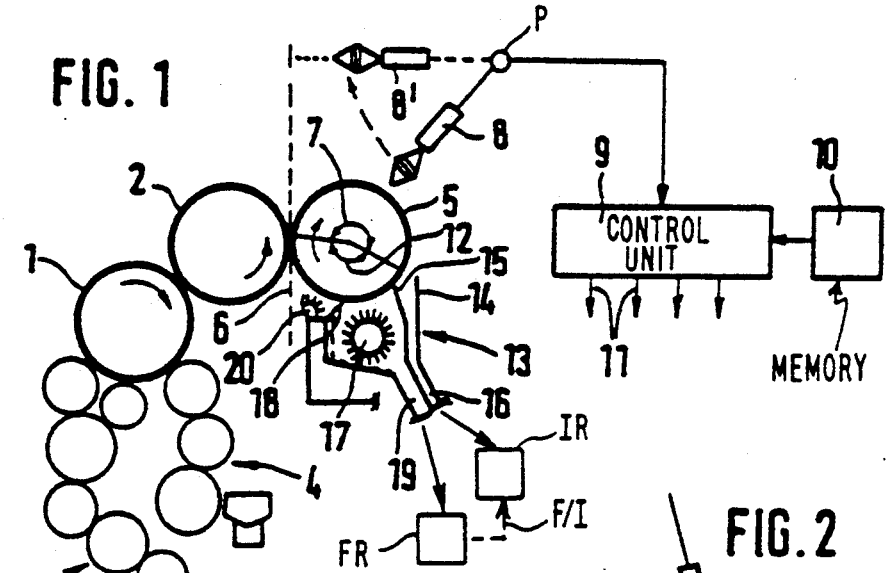
FIG. 2
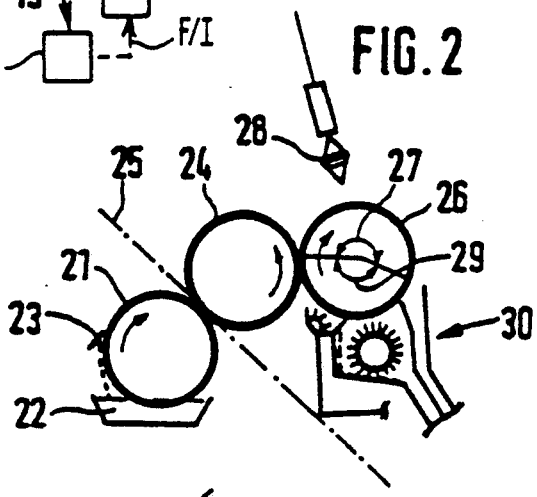
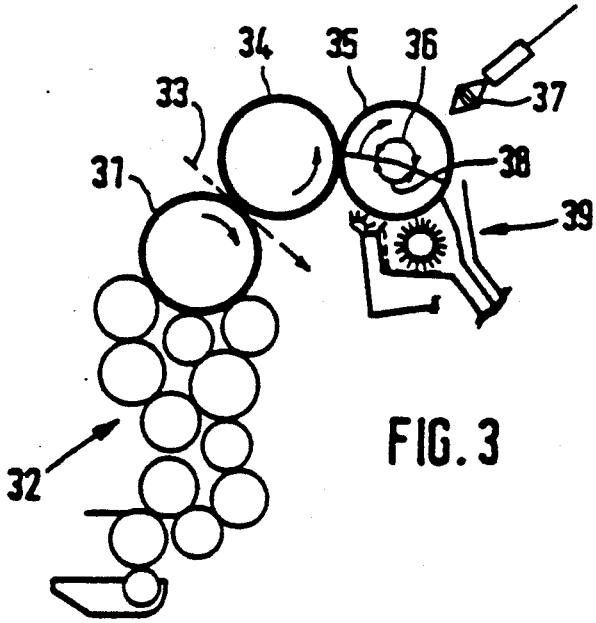
FIG. 3

METHOD OF OPERATING A PRINTING MACHINE DURING START-UP OR RUN-ON AND OPTICALLY TESTING A PRINTED IMAGE

Reference to related publication: German Patent 31 36 703.

FIELD OF THE INVENTION

The present invention relates to eliminating production of scrap copy during start-up or run-on of a printing machine, and to apparatus for carrying out the method.

BACKGROUND

Printing machines require an adjustment phase before they can provide perfectly printed copy. This start-up phase is independent of the type of printing machine, that is, whether it is a sheet-fed or web-fed machine, and whether the printing method is letterpress, gravure or planographic. During the start-up phase, adjustments are to be made so that the inking will be uniform, register accurate, and, in all other respects, the print is perfect. To do so, test samples are printed which are visually inspected by experienced personnel. Additionally, measurements can be taken of density of ink, register and the like, of the substrate on which printing is carried out. Apparatus to preset circumferential register, lateral register, diagonal register, and all other parameters relating to printing can reduce the production of scrap printed material, but could not entirely eliminate it. Test samples still had to be printed. If the number of printed production is to be small, the time to produce a perfectly printed sample can become a major production cost factor. This factor can be particularly high when the printing method is an offset process, since it is then necessary not only to control lateral and circumferential and other register parameters, but, additionally, the application of damping fluid so that the appropriate damping fluid-ink balance is obtained. This, also, increases start-up time and, hence, production costs. German Patent 31 36 703 describes arrangements to preset various registers, which, however, still have to be checked visually.

THE INVENTION

It is an object to provide a method and an apparatus in which the production of scrap during the start-up phase of a printing machine is reduced to a minimum or entirely eliminated.

Briefly, during start-up of the machine, and preliminarily in advance of a printing run, the information to be printed is transferred from a printing cylinder on a control or test cylinder which, preferably, has a surface which simulates the surface of the substrate on which printing is to be effected, i.e. is an analog of the substrate surface, for example white, with a surface characteristic similar to paper. The information which is transferred to the control cylinder will form an image on the control cylinder. This image is then optically tested, at a first partial circumferential range of the control cylinder subsequent to the printing line. The image transfer from the printing cylinder thus is examined, and information is derived fherefrom relative to parameters affecting the printing quality, based on adjustment of the operating system of the printing machine; such parameters are register, ink-water balance, inking density, color, and the like. The image which had been transferred to the control cylinder is then removed from the control cylinder at a second partial circumferential range, subsequent to the first range, for example by an erasing or cleaning apparatus in engagement with the control cylinder.

The use of a control cylinder on which the image to be reproduced is transferred, and, then again erased or washed off, permits reduction or entire elimination of test prints being made; thus, production of printed products which cannot be used approaches or becomes zero. This not only saves paper; the erasing or cleaning apparatus can readily be combined with a recycling apparatus so that ink which was used during the test run, as well as damping fluid, if an offset process is used, can be reconstituted and recycled.

DRAWINGS

FIG. 1 is a schematic illustration of an offset rotary printing machine having three cylinders, and employing the method in accordance with the present invention;

FIG. 2 is a schematic representation of a printing station of a gravure printing machine; and FIG. 3 is a schematic representation of a letterpress printing machine and employing the present invention.

DETAILED DESCRIPTION

The offset printing station shown in FIG. 1 includes a plate cylinder 1, a rubber blanket cylinder 2, i.e. a cylinder which has a yielding or soft surface, an inker 3, and a damper 4. In a printing run, a substrate 6 is passed between the blanket cylinder 2 and an impression cylinder 5, which has an unyielding or hard surface, e.g. a ceramic surface. Upon continued printing, the web or sheet 6 which is passed between the blanket cylinder 2 and the impression cylinder 5 receives the printed image, which is transferred or offset from the plate cylinder 1 to the blanket cylinder 2.

In accordance with the present invention, the printed information is preliminarily transferred from the blanket cylinder 2 not onto a substrate 6 but, rather, at the printing or cylinder contact line from the blanket cylinder 2 on the impression cylinder 5. In this instance, the impression cylinder 5 functions as a control or test cylinder. The surface of the impression cylinder 5, under run-on or start-up conditions, is so constituted that its roughness and, preferably, its color, is comparable or similar to, or an analog of that of the roughness and color of the substrate 6 which, later on, is to be used as the printed product. A white ceramic surface is particularly suitable.

In accordance with a feature of the invention, a first circumferential range 7, downstream—with respect to the direction of rotation of cylinder 5, as shown by the arrows in the cylinders—is used to permit optical examination and testing of the transferred image, which permits the formation of judgments with respect to the adjustment of parameters affecting the printed image, that is, which influence the quality of printing and the position of the printed image. Such parameters are, as well known for example, the preadjustment of the circumferential and lateral register, or registers, the adjustment of inked zones, thickness of the damping fluid film and the like. In the specification and claims, these parameters, or any one of them, will be referred to as "print quality parameters".

The optical examination in the first circumferential zone 7 can be carried out by observation of the printed transferred image by a printer. In accordance with the printer's judgment and observation, manual change of printing parameters can be carried out. Alternatively, the optical examination of the transferred image on the first range of cylinder 7 can be carried out by optical sensors, the test results of which are indicated at a central control panel, from which the various parameters affecting the image transfer can also be changed, either manually or automatically. Further, the optical examination of the transferred image can be done by means of opto-electronic sensors 8, see FIG. 1, which transfer electrical signals representative of optically sensed conditions of the printed image, for example position of register markers, characteristic elements of the printed image, inking density at characteristic points in the printed image and the like, as input signals to a control unit, typically formed by a computer 9. The computer 9 can access and read command or desired values from a memory 10 for the particular printing to be carried out, while considering characteristics of the substrates to be used, such as paper, for example, and the materials used in printing, for example the ink, color of the ink and the like, and provides error or difference signals 11 which are applied to the printing machine to change the respective parameter by controlling suitable adjustment elements, not shown, and well known in the printing machinery field. Such adjustment elements may, for example, be positioning motors to change the lateral, circumferential, or up-down register, control the inking in zones, control and, if necessary, change the speed of inker rollers in an inker train, the frequency of lifter rollers, and the like, until there is a zero or null difference between the actual value sensed by sensor 8 and command values supplied by memory 10.

In accordance with a further feature of the invention, a second circumferential range 12 follows the first circumferential range 7, in the direction of rotation of the control cylinder 5. An erasing or image extinguishing device 13 can be engaged against the control cylinder 5 which completely extinguishes the printed image on the control cylinder after the optical examination has taken place. The extinguishing or erasing apparatus 13, which can be a cleaning system, includes a housing 14, a first doctor blade 15, a first drainage duct 16, a roller brush 17 supplying a washing fluid to the test or control cylinder 5, a second doctor blade 18, a second drainage channel 19, and a dryer 20 located subsequent to the housing 14.

Operation of Erasing or Extinguishing System

The first doctor blade 15 strips off, preferably the entire, or essentially entire quantity of printing ink on the control cylinder 5 and drains that ink into the first drainage duct 16, from which it can be supplied to a printing ink recycling system shown schematically at IR. In the chamber or space formed between the first doctor blade 15 and the second doctor blade 18, any remaining ink is cleaned off the control cylinder 5 by the rotating roller brush 17, under supply of washing fluid. Any remnant portions of ink and washing fluid, still on the control cylinder 5, are removed by the second doctor blade 18 and conducted to a second recycling system FR via duct 19, for reconstituting washing and damping fluid and separating remanent ink therefrom, for reuse, as shown schematically at the fluid recycling unit FR, and for reuse or return of ink to the ink recycling unit IR, as shown schematically by the broken-line connection F/I.

The dryer 20 may be a hot air dryer, a heat radiator, or a similar arrangement, for example a tube extending parallel to the test or control cylinder 5 and blowing hot air against the surface thereof.

The cleaned and dried surface of the control cylinder can, upon continued rotation, receive another new, or the same printed image.

When all printing parameters are appropriately adjusted to the satisfaction of the printer or machine operator, printing on the substrate, that is, a printing run can now be started. The erasing or extinguishing system 13 is disengaged from the printing cylinder 5, and the printing cylinder 5 is disengaged from the blanket cylinder 2. The substrate 6, if in web form, can now be pulled into the printing machine or, if the machine is a sheet-fed machine, the sheet supply can be enabled. The impression cylinder 5 is then again engaged against the blanket cylinder, with the substrate 6 therebetween, or arranged to be fed therebetween, and the printing run may commence.

In accordance with a preferred feature of the invention, the opto-electronic sensor 8 is positioned on a pivotable support, pivotable about an axis P, which, during the start-up and testing phase, directs the opto-electronic sensor against the first circumferential range 7 of the control cylinder 5 and which can move the sensor to the position shown at 8', where optical examination of the printed image can be checked. FIG. 1 illustrates this movable positioning only schematically, by positioning the sensor 8, when at 8', in the back of the substrate which, for example, may be transparent or at least translucent. This permits continued optical examination of the printed image of the substrate 6 during normal printing.

Testing the printed image on the control cylinder is not limited to offset printing machinery. FIG. 2 illustrates an application of the method of the present invention to a gravure printing machine. Basically, a control cylinder or testing cylinder can be used with any kind of printing system, and, for example, the impression cylinder can be used for this purpose, by directly transferring the printed image thereon. Transfer of the printed image in an offset printing machine on the impression cylinder is carried out by transferring the image, at least indirectly, via a cylinder with a soft or yielding surface. Indirect gravure printing, indirect letterset or flexo-printing, likewise are suitable applications. If necessary, an additional cylinder can be used as a control or testing cylinder, as will be described in connection with the embodiments of FIGS. 2 and 3.

FIG. 2, schematically, illustrates a printing station of a gravure printing machine. A forme cylinder 21 accepts printing ink upon dipping into an ink trough 22; excess ink is stripped off by the doctor blade 23 and returned to the ink trough 22. An impression cylinder 24 is engageable against the forme cylinder 21. The impression cylinder 24 has a soft surface. During normal printing, a substrate 25 is passed between the forme cylinder 21 and the impression cylinder 24. The substrate may be a continuous web, or may be sheets suitably fed between cylinders 21 and 24, for prime printing by cylinder 21.

During the start-up phase, when there is no substrate between cylinders 21 and 24, a control cylinder 26 is engaged against the impression cylinder 24. Control cylinder 26, preferably, has a hard or unyielding surface, the structure of which is similar to that of the substrate 25. Preferably, a white ceramic surface is used.

In a first circumferential region 27, downstream of the printing line to the impression cylinder 24, optical sensor 28 senses, optically, the printed image transferred to the control cylinder, similar to the sensing by sensor 8, explained in connection with FIG. 1. A second circumferential range 29 follows the first range 27 which has an extinguishing, cancelling or cleaning system 30 engageable thereagainst which, in general construction, may be identical to the system 13, described and explained in connection with FIG. 1.

In operation, and during start-up, the image transferred to the control cylinder is first tested optically and then completely removed by the extinguishing system 30. A new image can then be applied to the cylinder 26 via the cylinder 24 at the impression line.

Evaluation circuitry to evaluate and, based on the evaluation, correcting or controlling the parameters affecting the printed image, based on signals derived from sensor 28, have been omitted from FIG. 2 since they can be similar to those explained in connection with FIG. 1.

FIG. 3, schematically, shows a letterpress printing machine which has a plate cylinder 31, inked by an inker 32 and, upon normal printing, prints the subject matter on a substrate 33, guided between cylinder 31 and an impression cylinder 34.

In accordance with a feature of the invention, a control or test cylinder 35 is provided, engaged against the impression cylinder 34 during start-up or run-on of the printing system and when there is no substrate 33 between the cylinders 31, 34. The control cylinder 35 will receive the image transferred to the impression cylinder 34.

An opto-electronic sensor optically tests the image transferred in a first circumferential range 36 on the test cylinder 35, range 36 following, downstream, the printing line of cylinder 35 with respect to the impression cylinder 34. Sensor 37 is directed to the surface of the test cylinder 35. Electronic evaluation, comparison and control apparatus control the parameters affecting the transferred image; none of that apparatus is shown in detail since it can be similar to the system 9, 10, 11 explained in connection with FIG. 1.

An erasing, extinguishing or cleaning apparatus 39 is located in a second circumferential range 38, downstream, with respect to the direction of rotation of cylinder 35. The extinguishing system 39 operates similarly to that of system 13, FIG. 1.

The extinguishing system 39 completely removes the image transferred by the impression cylinder 34 on the control cylinder 35, so that, upon each revolution, newly transferred information can be checked and tested on the first circumferential range 36 thereof.

Various changes and modifications may be made within the scope of the inventive concept.

I claim:

1. Method of operating a printing machine during start-up or run-on and to eliminate printing of scrap products while adjusting the machine, wherein the printing machine has a printing cylinder (2, 24, 34) positioned for printing information on a substrate (6, 25, 33) during a printing run, comprising the steps of preliminarily, and in advance of the printing run by the printing machine, transferring information to be printed from the printing cylinder (2, 24, 34) onto a control or test cylinder (5, 26, 35) to form an image thereof on the control or test cylinder, wherein said printing cylinder and said control or test cylinder are in printing engagement at a cylinder contact line;

optically testing, at a first partial circumferential range (7, 27, 36) subsequent to the cylinder contact line of the control or test cylinder, the image transferred from the printing cylinder onto said control or test cylinder, and deriving information from the printed image on said control or test cylinder within said range relative to print quality parameters;

removing the image transferred from the printing cylinder onto said control or test cylinder at a selected partial circumferential range (12, 29, 38) subsequent to said first partial circumferential range; and printing from said printing cylinder on the substrate after said testing step and during the printing run.

2. The method of claim 1, wherein said step of removing the image in said second partial circumferential range comprises erasing, extinguishing or cleaning said cylinder in said range by applying an erasing, extinguishing or cleaning apparatus (13, 30, 39) against the control or test cylinder within said second partial circumferential range.

3. The method of claim 1, wherein the printing cylinder (2, 24, 34) transferring the information has a yielding or soft surface, and the test or control cylinder (5, 26, 35) to which the information is being transferred has an unyielding or hard surface.

4. The method of claim 1, wherein the step of transferring the image during start-up comprises transferring said image on a ceramic surface on the control or test cylinder (5, 26, 35).

5. The method of claim 1, wherein the step of transferring the image during start-up comprises transferring said image on a ceramic surface on the control or test cylinder (5, 26, 35) and which is a white surface.

6. The method of claim 1, wherein the step of transferring the image during start-up comprises transferring said image on a surface on the control or test cylinder (5, 26, 35) which is similar in roughness to the surface of a substrate on which printing is to be carried out after start-up of the printing machine.

7. The method of claim 1, wherein the step of transferring the image during start-up comprises transferring said image on a ceramic surface on the control or test cylinder (5, 26, 35), which surface is white and has a roughness comparable to the surface characteristics of a substrate (6, 25, 33) on which printing is to be carried out subsequent to start-up of the printing machine.

8. The method of claim 1, wherein the step of optically testing said image transferred on the control or test cylinder comprises humanly observing and examining the printed image transferred thereto and then manually controlling and adjusting operating conditions of the printing machine based on said observation and examination.

9. The method of claim 1, wherein said step of optically testing the image transferred to said control or test cylinder comprises optically testing and sensing said image and indicating the sensed results on a control console;

and adjusting operating parameters controlling said operating conditions of the printing machine in accordance with the sensed image.

10. The method of claim 9, further including movable means (P) supporting said sensor (8); and comprising the steps of selectively placing said sensor (8, 28, 37) in sensing position with respect to said first circumferential range (7, 27, 36) of the control or test cylinder (5, 26, 35), and in a second position for sensing the printed information on the substrate (6, 25, 33) upon printing by said printing machine on a substrate subsequent to start-up thereof; and deriving optical test data of the actual printed information on said substrate from said sensor (8).

11. The method of claim 1, wherein the step of optically testing the transferred image on said control or test cylinder comprises opto-electronically scanning said image with opto-electronic sensors (8, 28, 37);

deriving actual sensed values from said sensors;

applying said actual sensed values to a control unit;

comparing said sensed values in said control unit with desired or command values, and deriving comparison signals representative of the difference between sensed actual values and said desired or command values;

and applying said comparison signals (11) to the printing machine to control said operating parameters to null the difference or comparison or deviation signals.

12. The method of claim 10, further incuding movable means (P) supporting said sensor (8); and comprising the steps of selectively placing said sensor (8, 28, 37) in sensing position with respect to said first circumferential range (7, 27, 36) of the control or test cylinder (5, 26, 35), and in a second position for sensing the printed information on the substrate (6, 25, 33) upon printing by said printing machine on a substrate subsequent to start-up thereof; and deriving optical test data of the actual printed information on said substrate from said sensor (8).

13. The method of claim 1, wherein said step of removing the image transferred onto the control or test cylinder (5, 26, 35) in said second circumferential range (12, 29, 38) comprises applying at least one doctor blade (15, 18) against said control or test cylinder, then washing said control or test cylinder, and then drying said control or test cylinder.

14. The method of claim 13, including the step of recycling at least one of: printing ink; washing fluid, derived from said control or test cylinder (5, 26, 35) during said removal step.

15. The method of claim 1, wherein said printing machine comprises a rotary offset printing machine;

and wherein said control or test cylinder comprises an impression cylinder (5) engageable against a blanket cylinder (2) of said offset printing machine.

16. In combination with a printing machine which prints information on a substrate (6, 25, 33) to be printed and having a substrate surface, apparatus to reduce or eliminate printing of scrap substrate products while adjusting the machine during start-up or run-on of a printing run, wherein the printing machine includes a printing cylinder (2, 24, 34) for transferring the printed information onto the substrate (6, 25, 33) to be printed during a printing run, said apparatus further comprising, in accordance with the invention, a control or test cylinder (5, 26, 35) having a surface which is an analog of the surface of the substrate to be printed, said control or test cylinder being engageable against the printing cylinder without an intervening substrate preliminarily and in advance of the printing run of the printing machine so that the printed image is first, preliminarily, transferred from the printing cylinder onto the control or test cylinder, to permit observation of the transfer of the printed information onto the control or test cylinder over a first partial circumferential range (7, 27, 36) and to derive information therefrom relating to adjustment of operating parameters controlling operating conditions of the printing machine affecting printing quality based on adjustment of operating devices of the printing machine; and an erasing or extinguishing means (13, 30, 39) engageable against said control or test cylinder (5, 26, 35) for erasing the printed image preliminarily transferred thereto from the printing cylinder, and to permit, still preliminarily, transfer onto said control or test cylinder of a subsequent preliminary printed image.

17. The combination of claim 16, wherein said erasing or extinguishing means comprises a washing apparatus including at least one doctor blade (15) stripping ink off the control or test cylinder, and means (17) for applying a washing fluid against the surface of the control or test cylinder (5, 26, 35).

18. The combination of claim 17, further including recycling means (IR, FR) coupled to said erasing or extinguishing and washing means (13, 30, 39) and receiving stripped-off ink from the control or test cylinder, and washing fluid from the washing means (17).

19. The combination of claim 16, further including opto-electrical sensing means (8, 28, 37) directed for sensing the image on said control or test cylinder (5, 26, 35) transferred thereto from the printing cylinder (2, 24, 34) and deriving signals representative of said image to permit control of the operating devices of the printing machine by controlling parameters thereof affecting printing quality.

20. The combination of claim 19, further including an electrical control unit (9) coupled to receive sensed signals from said sensors (8, 28, 37), and receiving command or desired signals, and generating deviation or comparison or error signals, said deviation or command or error signals (11) being applied to said printing machine to vary the adjustment of operating devices thereof to null the deviation, comparison, or error signals and to conform the printing quality to that represented by said command or desired signals.

* * * * *